US007661553B2

(12) United States Patent
Zeiron

(10) Patent No.: US 7,661,553 B2
(45) Date of Patent: Feb. 16, 2010

(54) APPARATUS FOR SERIALLY DISPENSING FOLDER SHEET PRODUCTS

(75) Inventor: Kent Zeiron, Gothenburg (SE)

(73) Assignee: SCA Hygiene Products AB, Gothenburg (SE)

( * ) Notice: Subject to any disclaimer, the term of this patent is extended or adjusted under 35 U.S.C. 154(b) by 119 days.

(21) Appl. No.: 11/583,738

(22) Filed: Oct. 20, 2006

(65) Prior Publication Data

US 2007/0034638 A1 Feb. 15, 2007

Related U.S. Application Data

(63) Continuation of application No. PCT/SE2004/000699, filed on May 7, 2004.

(51) Int. Cl.

| | |
|---|---|
| ***A47K 10/24*** | (2006.01) |
| ***B65H 1/00*** | (2006.01) |
| ***B65G 11/00*** | (2006.01) |
| ***B65G 1/16*** | (2006.01) |

(52) U.S. Cl. ..... 221/46; 221/52; 221/57; 221/59; 221/35; 221/56; 221/305; 221/60; 312/333; 312/71; 312/46; 312/61

(58) Field of Classification Search ..... 221/46, 221/45, 35, 56, 305, 52, 59, 60, 57; 361/385; 312/333, 71, 46, 61

See application file for complete search history.

(56) References Cited

U.S. PATENT DOCUMENTS

| | | | | |
|---|---|---|---|---|
| 1,901,243 | A * | 3/1933 | Horwitt | 221/279 |
| 1,993,885 | A | 3/1935 | Horwitt | |
| 2,426,136 | A | 8/1947 | Agamaite, Jr. | |
| 2,547,856 | A | 4/1951 | Cofrin et al. | |
| 3,068,055 | A * | 12/1962 | Lenzi et al. | 312/50 |
| 3,208,636 | A * | 9/1965 | Filipowicz | 221/57 |
| 3,214,227 | A * | 10/1965 | Filipowicz | 312/71 |
| 4,298,139 | A * | 11/1981 | Radek | 221/198 |
| 4,329,001 | A * | 5/1982 | Filipowicz et al. | 312/71 |
| 4,953,747 | A * | 9/1990 | Wenkman et al. | 221/45 |
| 5,076,466 | A * | 12/1991 | Petterson et al. | 221/46 |
| 5,131,561 | A * | 7/1992 | Casperson et al. | 221/35 |
| 5,292,198 | A * | 3/1994 | Rock et al. | 384/21 |
| 6,257,443 | B1 | 7/2001 | Lacount | |
| 6,629,667 | B2 * | 10/2003 | Tramontina | 242/593 |
| 6,708,841 | B2 * | 3/2004 | Baughman | 221/46 |
| 6,883,885 | B2 * | 4/2005 | Judge et al. | 312/334.46 |
| 2004/0206768 | A1 * | 10/2004 | Tramontina et al. | 221/46 |
| 2005/0088069 | A1 * | 4/2005 | Greenwald et al. | 312/333 |
| 2006/0118568 | A1 * | 6/2006 | Hochtritt et al. | 221/45 |

FOREIGN PATENT DOCUMENTS

| | | |
|---|---|---|
| EP | 0 506 243 | 9/1992 |

* cited by examiner

*Primary Examiner*—Gene O. Crawford
*Assistant Examiner*—Rakesh Kumar
(74) *Attorney, Agent, or Firm*—Young & Thompson

(57) ABSTRACT

A dispenser for dispensing folded sheet products from a stack of folded sheet products, includes: an open-ended body, a front panel provided with a dispensing opening, a rear panel, and a transverse panel located between the front and rear panels. The dispenser further includes a support member for receiving the stack of the folded sheet products and at least one locking mechanism located between the support member and at least one longitudinal wall of the open-ended body.

14 Claims, 5 Drawing Sheets

APPARATUS FOR SERIALLY DISPENSING FOLDER SHEET PRODUCTS

FIELD OF THE INVENTION

This invention relates to apparatus for serially dispensing folded sheet products, such as paper napkins, from a stack of such products. In addition, the invention relates to an arrangement for facilitating opening of such a dispenser.

BACKGROUND OF THE INVENTION

Presently public places, such as restaurants, make available to the consumers dispensers of tissue paper items such as serviettes table napkins, towels or sanitary paper.

In general, a napkin dispenser comprises an open-ended case having a substantially parallelepiped shape and including a front panel fitted with a transverse slot through which the napkins are extracted. The napkins are assembled as a pack inside the dispenser either in a mere juxtaposed manner, or independently of each other, or interleafed with each other. Such dispensers can be set down flat or vertically against a wall.

Common standard dispensers of this type are usually assembled from multiple sections. A body may comprise up to four separate parts, which are assembled by rivets, welds or other means, depending on the material used. In addition, the body may include an end wall and guiding means for a push plate for napkins or the like. These components must also be attached to selected parts of the inner walls of said body. As a rule, the cost of the dispenser and the assembly thereof is directly related to the number of component parts.

In order to refill a dispenser, a user must remove the front panel to access the space into which a stack of napkins is to be loaded. This may either be done by simply removing the front panel, to expose the pus-plate, whereby a new stack of napkins is inserted into the body of the dispenser against the action of the spring loaded push plate. A problem with this type of loose front panel is that it may be difficult to remove, as there is no obvious way to grip the panel. Also, when replacing the front panel after filling, the stack of napkins must be pushed back while the front panel is repositioned and re-attached. This relatively complicated procedure will more often than not cause at least the outermost napkin of the stack to be damaged or displaced relative to the dispensing opening.

In an alternative dispenser, a user must locate and release one or more latches positioned inside the dispenser in order to allow the front panel and an associated holder to be withdrawn from the dispenser for re-filling. Such a dispenser is known from U.S. Pat. No. 4,329,001. As in the above example, a problem with this type of dispenser is that it may be difficult to remove, as there is no obvious way to grip the panel. The user must first know that the front panel is retained by a latch (or latches), and second know where to find said latch. This is not obvious, as the latch is accessed through the dispensing opening, requiring the user to be trained for opening the dispenser, or that the body of the dispenser is provided with instructions for refilling. Apart from detracting from the design and general appearance of the dispenser, such instructions may be worn away with time. A user not familiar with the dispenser may therefore cause damage to the retaining mechanism trying to force the front panel of the dispenser open.

Hence there exists a need for a dispenser provided with means for facilitating an improved method of opening and closing of such a dispenser for the purpose of re-filling.

SUMMARY OF THE INVENTION

The above problems are solved by providing a dispenser having a locking mechanism as claimed.

According to a first preferred embodiment, the invention relates to a dispenser for dispensing folded sheet products from a stack of said folded sheet products, said apparatus comprising, an open-ended body, a front panel, which front panel is provided with a dispensing opening, a rear panel, and a transverse panel located between said front and rear panels. The dispenser further comprises a support member for receiving said stack of said folded sheet products and at least one locking mechanism located between the support member and at least one longitudinal wall of the open-ended body.

The front panel and the support member attached to each other and may be retained in an operative, dispensing position in the open-ended body by means of a suitable releasable locking means, which will be described in further detail below. The transverse panel is arranged slidable along the support member, and is biased in the direction of the front panel by a suitable spring means. The front panel may be provided with a section arranged to be pushed into the dispenser, to cooperate with internal surfaces of the edge of the open-ended body, or be arranged flush against the end surface of said body. The rear panel may be attached by means of an adhesive, or by using a force fit relative to the open-ended body. It is also possible to provide the rear panel with surfaces cooperating with the longitudinal ribs and/or the internal surface of the edge of the open-ended body, in order to attach the rear panel to the said body.

The closed profile making up the open ended body may comprise at least two first longitudinal extruded ribs arranged on opposing walls to guide said support member. In addition, the transverse panel is arranged slidable along the support member, which support member is joined to the front panel.

When located in the operative dispensing position in the open-ended body, the assembled support member, front panel and transverse panel is mounted selectively movable relative to said body, between a first, dispensing position and a second, filling position. A biasing means may be arranged to spring load said transverse panel in the direction of the front panel, thereby exerting a feeding force on the stack of folded sheet products. As successive folded products are removed, the transverse panel will be pushed by the biasing means along said support member towards the front panel. The biasing means acting on the transverse panel may also provide a sufficient spring loading of the assembly comprising the front panel and the support member in the direction of the front panel, in order to facilitate opening of the dispenser for refilling. By releasing a locking means for retaining the front panel and the support member in the dispenser body the said assembly is pushed a short distance out of the dispenser. The spring-tension and effective length of the biasing means is determined by the length of the support member.

The sliding movement of the transverse panel may be guided by said longitudinal ribs in the open-ended body, or additionally by guiding means provided in the support member. This is to ensure that the stack of folded products is fed forwards and held against the rear surface of the front panel and its dispensing opening. In its first, dispensing position the inner, rear end of the support member is located near the internal wall of the rear panel. In its second, filling position the rear end of the support member is located near the front end surface of the open-ended body, whereby a stop means is provided to prevent the support member from being pulled out of the open-ended body. In the latter position, the front surface of the transverse panel is arranged to extend a short distance out of the open-ended body. During filling of the dispenser, the transverse panel is held in this position against said stop means by the biasing means. In order to accommodate various lengths of the open-ended body, the support member may also be extruded and cut to a desired length. The transverse panel may either be guided by said at least two first longitudinal ribs, or by said two first ribs and at least two further, second longitudinal ribs. The biasing means may be arranged between the first and second longitudinal ribs and is attached between the transverse panel and the front end of the open-ended body.

As stated above, the front panel and the support member may be retained in the open-ended body by means of a suitable releasable locking means, which at least one locking mechanism located between the support member and at least one longitudinal wall of the open-ended body.

According to a preferred embodiment each locking mechanism is resiliently biased into a locking position, in order to ensure that the support member is securely retained in the dispenser.

Each locking mechanism may be provided with an actuator is located on the support member. Also, each actuator may engage with a recess in a corresponding longitudinal wall, in order to lock the support member in a dispensing position. The actuator or actuators may be located at one end of a corresponding resilient member arranged to bias the actuator into said recess, which resilient member may be an elongated, resilient tongue. The longitudinal axis of the said member is preferably located in the general direction of movement of the above-mentioned assembly, when withdrawn for re-filling. The resilient member may preferably, but not necessarily, be attached so that the tongue extends at an angle away from the said assembly, towards the rear of the open-ended body. The width-to-length relationship for the resilient member is determined by the choice of material and the desired spring force required for releasing the locking mechanism. The angle of the said tongue is in turn dependent on the length-to-width relationship and the distance between the said assembly and the adjacent outer wall of the open-ended body.

The resilient member may be attached to the support member as a separate unit, wherein the resilient member may comprise an integrated attachment section and resilient section. This separate unit may be cut or stamped from a relatively thin steel sheet with suitable resilient properties, such as stainless steel. Alternatively, the unit may be manufactured by, for instance, stamping or injection moulding a thermoplastic material such as polyoxymethylene (POM), polytetrafluoroethylene (PFTE), polyvinylidenfluoride (PVDF), polyamide, Polyamide PA6 Grivory, or other suitable wear resistant thermoplastic materials. The materials may be used with or without addition of glass fibre, Teflon® and similar materials.

Alternatively the resilient member may be integrated with the support member. Depending on the material in the support member, the said member may be moulded or stamped out of a side or bottom surface of the support member.

Each actuator may be located in at least one of the longitudinal walls making up the dispenser, that is, in a bottom wall, a top wall or at least one side wall of the open-ended body. In addition, each actuator may be operable through said recess, which recess is a through hole in said wall. Such an actuator may be in the shape of a round or oval component, or button, having substantially the same cross-sectional shape as the corresponding recess. In order to cooperate with the recess the actuator must be slightly smaller, so that it may easily snap into place under the spring force of the resilient member when the support member reaches its operative position in the dispenser. The said button has an outer substantially flat surface that is at least partially flush with and/or located a small distance inside the plane of the outer surface of the wall of the dispenser, when the resilient member is in its operative, or rest position. In order to facilitate assembly of the dispenser after re-filling, a section of the inner, front end of the open-ended body may be provided with a bevelled guide surface. The guide surface has a vertical, or horizontal, extension that is larger the corresponding size of the actuator. According to one embodiment, the actuator has an angled outer surface, at least partially flush with the plane of the outer surface of the wall of the dispenser. According to a further embodiment, the actuator has an outer surface that is located a small distance inside and substantially parallel to the plane of the outer surface of the wall of the dispenser. In both cases the outer, initial part of the bevelled guide surface must be located closer to the plane of the outer surface of the wall of the dispenser than the rear edge of the outer surface of the actuator. This will ensure that the actuator does not catch against the end of the front end of the dispenser.

The actuator is preferably made from a wear resistant material, as it will come into sliding contact with the inner wall of the open-ended dispenser body during every refilling operation. The actuator may be made from the same material as the separate unit described above. In this case, the actuator and the resilient member may be made as an integral part, preferably, but not necessarily from a thermoplastic material. Alternatively it may be attached as a separate component or button onto the end of the resilient member. In this case, the actuator is made from a wear resistant material, such as stainless steel, that is welded, riveted or attached by an adhesive onto the resilient member. In addition to the suggested cross-sectional shapes round or oval, any suitable geometrical form is of course possible for the actuator and its corresponding recess.

According to an alternative embodiment, the locking mechanism may be provided with an actuator that is located on an inner wall of the open-ended body. In this case the actuator is in engagement with a notch in the support member, in order to lock the support member in a dispensing position. The actuator may be located at one end of a pivoting lever, whereby a locking member is located on the opposite end of the lever and is resiliently biased into contact with the support member. The pivoting lever has an attachment point mounted on an inner wall of the dispenser.

A stated above, a biasing means is located between said transverse panel and the open-ended body, which biasing means spring loads support member, the front face and the transverse panel in the direction of the front end of the dispenser. The biasing means may be arranged to displace the support member, the front face and the transverse panel a predetermined distance out of the dispenser upon release of the locking means.

The locking mechanism for the latter embodiment may be actuated by said at least one actuator, which actuator may be operable through a corresponding wall of the open-ended body. Each actuator may be located in at least on of the longitudinal walls making up the dispenser, that is, in a bottom wall, a top wall or at least one side wall of the open-ended body. In addition, each actuator may be operable through said recess, which recess is a through hole in said wall. Such an actuator may be in the shape of a round or oval component having substantially the same cross-sectional shape as the corresponding recess. In order to cooperate with the recess the actuator must be slightly smaller, so that it may easily snap into place under the spring force of the resilient member when the support member reaches its operative position in the dispenser. The thickness of the actuator may be chosen with respect to the available space between the support member and the adjacent inner wall of the dispenser body, as well as the thickness of the dispenser wall adjacent the recess. The actuator is preferably made from a wear resistant material, as it will be in sliding contact with the inner wall of the dispenser body during every refilling operation. In addition to the suggested cross-sectional shapes round or oval, any suitable geometrical form is of course possible for the actuator and its corresponding recess.

The dispenser may be given a desired capacity for folded sheet products by selecting a suitable length for the open-ended body. The length can be selected without affecting the positioning or fixation of the front and rear panels. In addition, by extruding the open-ended body the dispenser may be given any desired cross-section. The dispenser may comprise an open-ended body having a closed cross-sectional profile in the form of a single extruded section. The profile preferably has a substantially rectangular or square cross-section, adapted to fit a predetermined size of folded sheet product. Alternatively, the dispenser may comprise an open-ended body having a closed cross-sectional profile in the form of two extruded sections. The extruded sections may be attached by simultaneously extruded, mating snap connections. The connections may be located along opposing side walls, or along opposing or diagonal corners of the body.

The first and second longitudinal ribs may be substantially L-shaped and arranged facing each other. However, the ribs may also be arranged facing the same way or away from each other, and be provided with other cross-sectional shapes, such as a T-shape, depending on the shape of corresponding surfaces on the transverse panel and/or the support member.

The longitudinal ribs may be machined in order to end a predetermined distance from said end surfaces of the open-ended body, whereby the front and rear panels may extend substantially the corresponding distance into the open-ended body. This involves cutting or machining a predetermined section of the outer ends of any extruded ribs so that they become flush with the peripheral wall of the open-ended body adjacent one or both end surfaces of the open-ended body.

Alternatively the longitudinal ribs may extend over the full length of said open-ended body, whereby the front and rear panels may be arranged to extend past and/or between the ribs. This embodiment may contribute to reducing the cost of manufacture of the dispenser, as virtually no machining of the open-ended body will be required before assembly. Depending on the choice of material to be extruded, the open-ended body can simply be cut to length, deburred and optionally be surface treated before assembly In its basic form, a dispenser of this type may comprise three parts, that is, an open-ended body, a front section and a rear section. According to said first preferred embodiment, the front section is provided with a dispensing opening and means for holding and feeding a stack of folded paper products. This embodiment is best suited for relatively long dispensers having a square or rectangular cross-section. For example, this type of dispenser may have a length to width ratio in excess of 2:1. Note that this figure is given by way of example only and do not in any way limit the scope of the invention.

As the body may be made from extruded sections, the customer can order a size of dispenser specifically adapted to his needs. When ordering a non-standard size, the only additional costs involved will be the material cost for an increase in the length of the body and the support member respectively. Minor adaptations may be required for the spring acting on the transverse panel, depending on the change in length of the support member relative to a standard length.

According to the invention as described in the above embodiments and the following examples, the dispenser is preferably, but not necessarily, designed for dispensing folded sheet products from a stack of individual folded webs. The term "folded sheet products" is defined as including either of individually stacked webs, overfolded webs or interfolded webs, or similarly arranged sheet products. The webs or sheets may or may not be joined by manually separable perforations or by a number of local attachment zones or connecting points. The stack of individual folded webs may be a stack of fibrous webs. Desirably, the stack of folded products is a stack of absorbent sheets or webs such as, for example, absorbent non-woven products. More desirably, the stack of folded webs is a stack of absorbent fibrous or paper sheets or webs such as, for example, napkins, towels, tissues or the like.

Other features, advantages, and objects of the present invention will become apparent with reference to the following description and accompanying drawings.

BRIEF DESCRIPTION OF THE DRAWINGS

In the following text, the invention will be described in detail with reference to the attached drawings. These drawings are used for illustration only and do not in any way limit the scope of the invention. In the drawings.

DETAILED DESCRIPTION OF THE INVENTION

Figure 1:
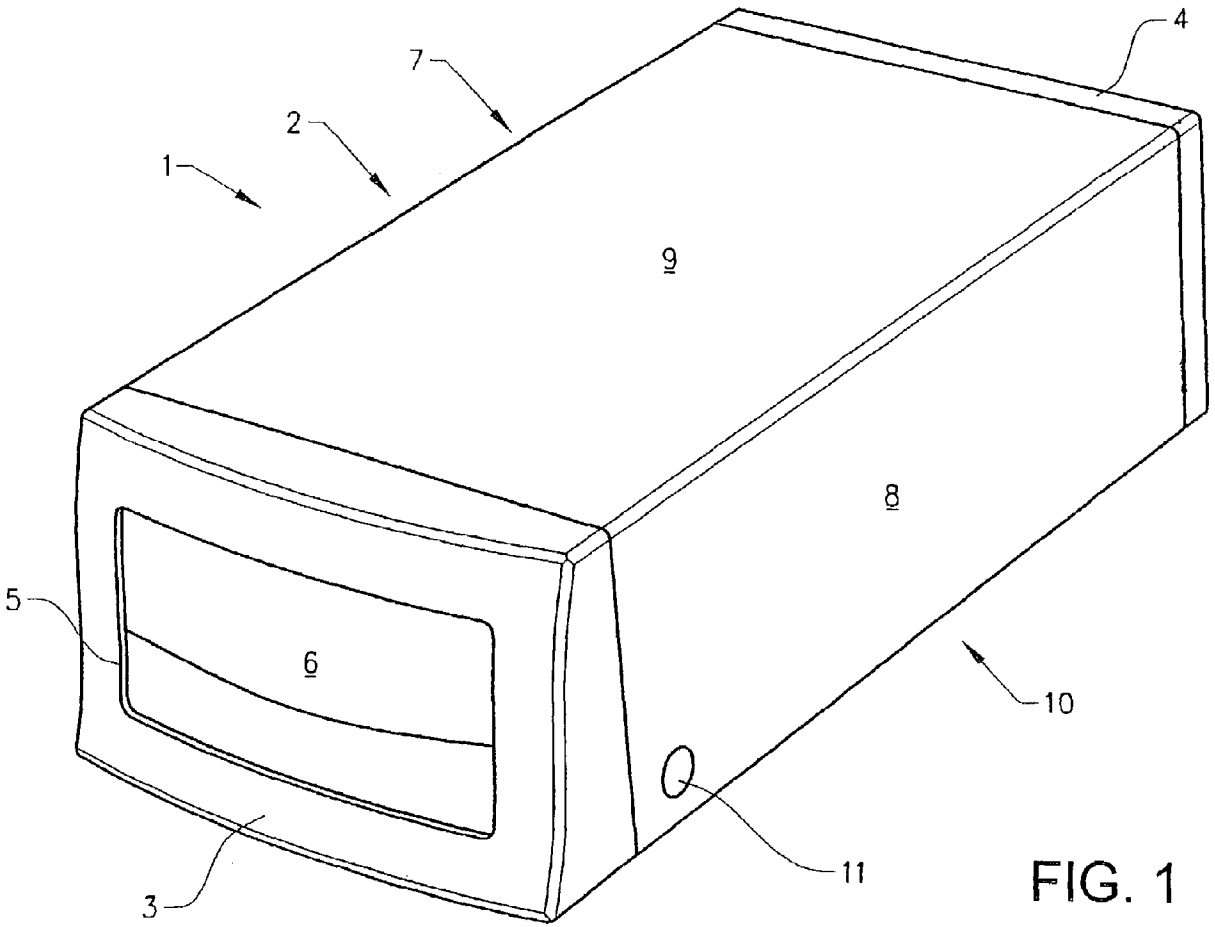
FIG. 1 shows a dispenser with a locking mechanism according to a first embodiment of the invention.

FIG. 1 shows a dispenser according to a first embodiment of the invention, which dispenser 1 comprises a preferably, but not necessarily, extruded central body 2, a front panel 3 and a rear panel 4 at opposite ends of said body. The front panel 3 is provided with a dispensing opening 5 for folded paper products such as a stack of paper napkins 6. The central body 2 comprises an open-ended, substantially rectangular section having a pair of opposing side walls 7, 8, an upper, or top wall 9 and a lower, or bottom wall 10. The embodiment of FIG. 1 is provided with means for opening the dispenser by releasing a locking mechanism (see FIG. 2), which mechanism is provided with an actuator 11 adjacent the front end of the dispenser.

In the following text, any features that are identical (albeit mirrored) on opposed sides of the dispenser will be given the same reference numerals. It should also be noted that the thickness of the walls shown in this and any subsequent figures has been exaggerated for reasons of clarity.

Figure 2:
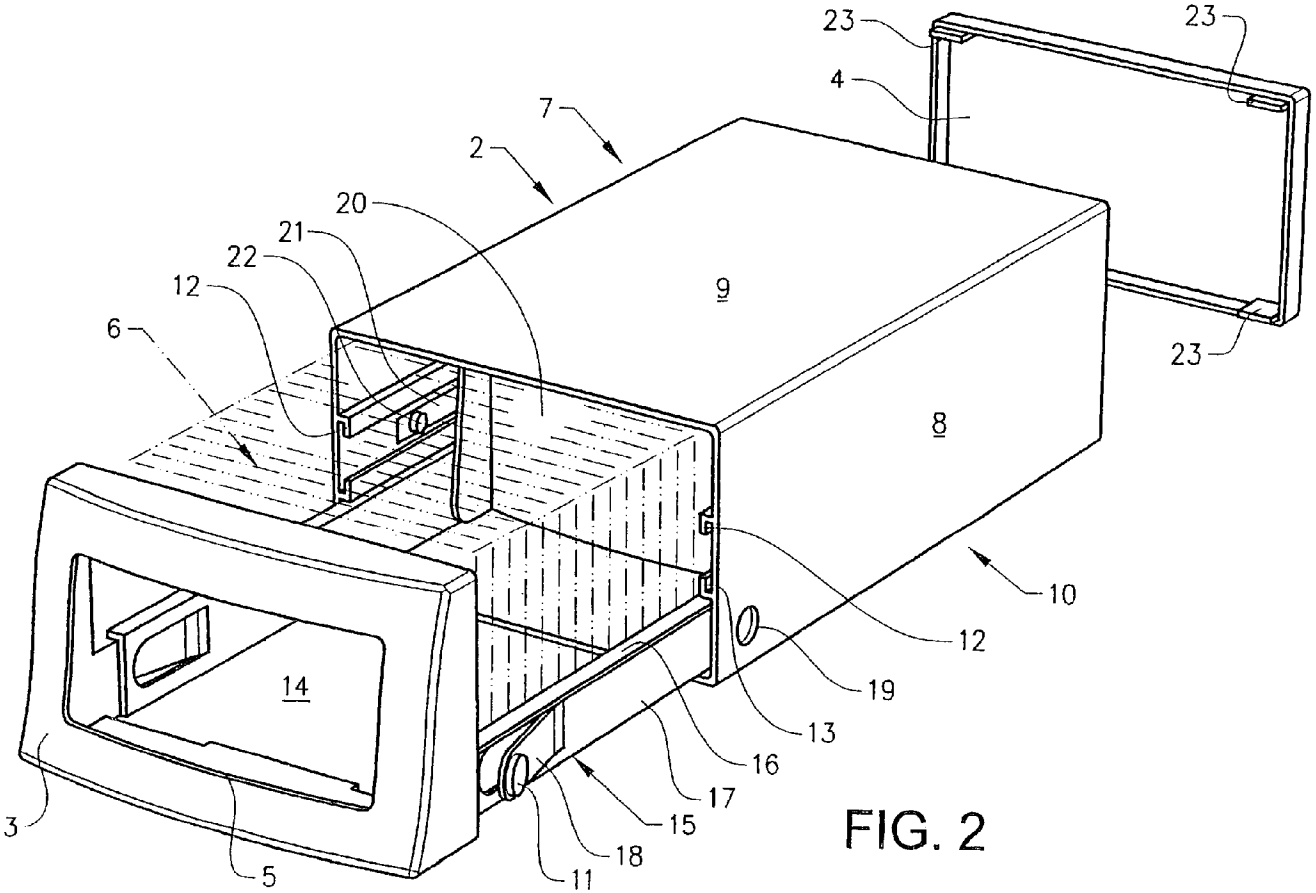
FIG. 2 shows an exploded view of a dispenser as shown in FIG. 1.

FIG. 2 shows an exploded view of a dispenser including the central section of FIG. 1. The extruded central body 2 is provided with two extruded longitudinal upper and lower ribs 12, 13 along the inside of the side walls 7, 8. The front panel 3 is joined to a drawer 14 for holding said stack of folded products. The front panel 3 and the drawer 14 are releasable from the central body 2 upon actuation of a locking means 15, for the purpose of refilling the dispenser. In the figure, the front panel 3 is shown in a partially pulled out position. The front panel 3 is attached to the drawer 14 that is slidable relatively to the central body 2 along the first and second longitudinal ribs 12, 13. The undersides of the lower, second ribs 13 cooperate with corresponding upper edges 16 of a pair of side walls 17 of the drawer 14. The locking means 15 is mounted on each outer side 17 of the drawer 14 and comprises an outwardly angled, resilient tongue 18, having an actuating button 11 mounted on its free, forward facing end. In the embodiment shown, the resilient tongue 18 is integrated with the side wall 17 of the drawer 14. The front edge of the actuating button 11 is arranged to cooperate with a corresponding opening or hole 19 in the side walls 7, 8 of the central body 2. The drawer 14 is released by pressing both actuating buttons 11 inwards, against the spring force of the resilient tongue 18 out of contact with the edges of the hole 19, whereby the front panel 3 and drawer 14 is pushed a short distance out of the dispenser. This is achieved by providing a push-plate 20 that is spring loaded in the direction of the front panel 3. When the dispenser is empty, the push-plate 20 is in contact with the front panel 3. When the locking means 15 is released, a front surface on the push-plate 20 will be pushed a short distance out of the dispenser by a coil spring 21 (partially shown in FIG. 2), against a stop means 22 that acts as an attachment means for a front end of the coil spring 21. This movement will also displace the front panel 3 away from the front end of the dispenser, allowing it to be gripped and pulled out into a re-filling position. To close the dispenser after re-filling, a force is applied to the front panel 3, whereby the rear edge of the actuating button 11 will come into contact with the inner side wall of the central body 2. The actuating button 11 and the resilient tongue 18 will then be kept depressed by said inner wall of the side wall 8, until the actuating button 11 reaches the hole 19 and returns to its locking position under the action of the resilient tongue 18.

A stack of folded paper products 6 placed on the drawer 14 is indicated with dash-dotted lines, for reasons of clarity. At the opposite end of the stack, relative to the front panel 3, the drawer 14 is provided with a transverse panel or push-plate 20. As stated above, the push plate 20 is slidable relative to the drawer 14 and is spring loaded in the direction of the front panel 3. The rear panel 4 is fixedly attached to the central body 2 using the locating tabs 23 and a suitable adhesive. When the dispenser has been filled and the assembly comprising the front panel 3, drawer 14 and push plate 20 has been locked in place in the central body 2, the spring loaded push plate 20 will cause the stack of folded products 6 to be fed forwards in the direction of the dispensing opening 5.

Figure 3:
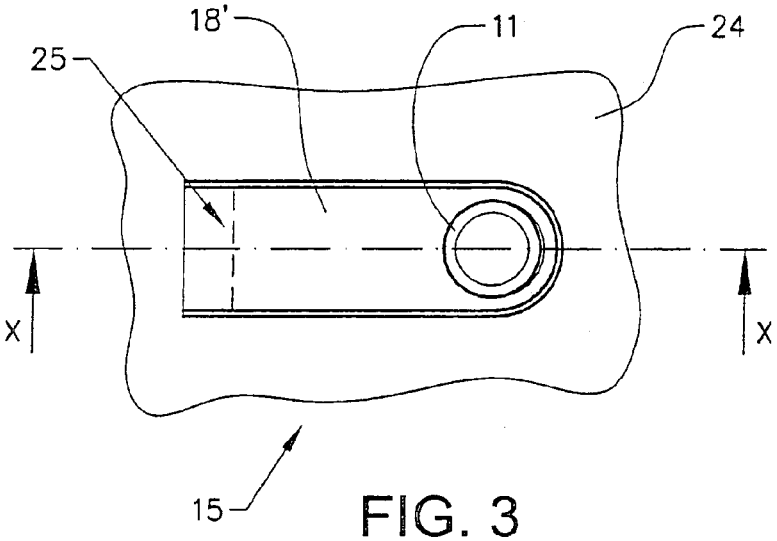
FIG. 3 shows a locking mechanism according to a second embodiment of the invention.

FIG. 3 shows a locking mechanism according to a second embodiment of the invention. In this embodiment, the locking mechanism 15 comprises a substantially rectangular component 24 made from sheet metal. The resilient tongue 18' is stamped out of said component 24, and bent along a line 25 at substantially right angles to the longitudinal extension of the resilient tongue 18', at a section joining one end of the resilient tongue 18' to the component 24. The actuator button 11 is attached to the opposite, free end of the resilient tongue 18'.

The component can be made from any material having suitable wear and resilient properties, such as spring, steel stainless steel or a suitable plastic material. The thickness of the component and the length and width of the resilient tongue are chosen to give a sufficient spring loading to ensure a secure locking function, while providing a stiffness that can be relatively easily overcome by a user wishing to release the locking mechanism for re-filling of the dispenser. In the embodiment of FIG. 3 the component is made from stainless steel having a thickness of 0.53 mm, having a resilient tongue approximately 48 mm long and 15 mm wide. The actuator button is made from a suitable wear resistant material, in this case stainless steel with a thickness of approximately 2.65 mm.

According to a further embodiment, the component 24 is injection moulded from a thermoplastic material. Suitable wear resistant thermoplastic materials are for instance PTFE or POM. In this embodiment, the component is made from Schulaform TF20® (20% PTFE), made by Schulman Plastics GmbH, having a resilient tongue with a thickness of approximately 1.55 mm, a length of approximately 48 mm and a width of approximately 18 mm. In this case, the actuator button and the resilient arm are moulded as an integral component, whereby the thickness of the combined arm and button is selected for cooperation with the recess in the body of the dispenser as described below.

Figure 4A:
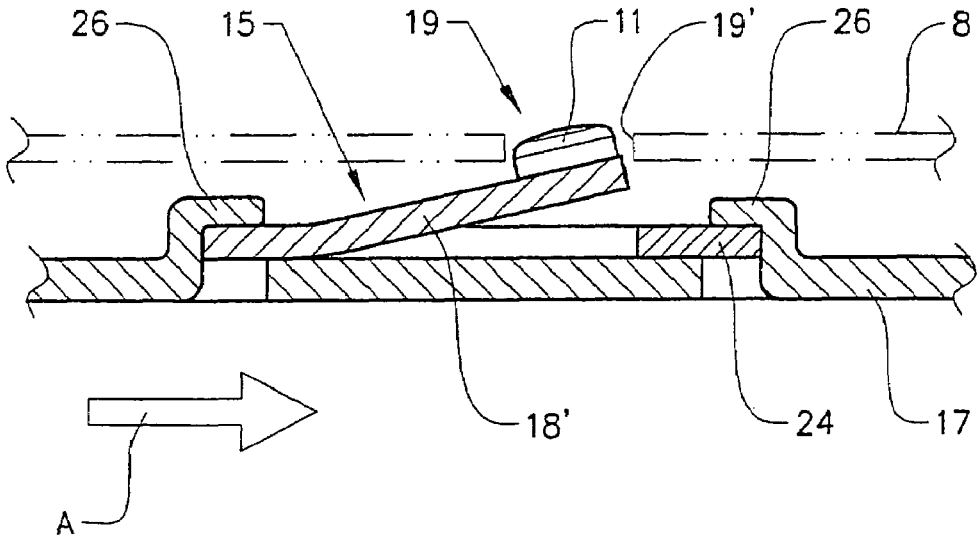
FIG. 4A shows a cross-section of the locking mechanism of FIG. 3, prior to opening the dispenser.

FIG. 4A shows a cross-section x-x of the locking mechanism of FIG. 3. The figure shows the component 24 mounted onto the side wall 17 of the drawer by means of a number of notches 26 stamped out of said side wall. The figure also indicates how the actuator button 11 cooperates with an edge 19' of the hole 19 in the side wall 8 (shown in dash-dotted lines) of the dispenser to hold the drawer in its operative position. The arrow A indicates the direction of movement of the drawer when the locking mechanism 15 is released. The actuator button is provided with a bevelled or rounded outer edge that will assist in guiding the actuator button back into the dispenser, against the force of the resilient tongue, when the drawer is pushed back in. The thickness of the component, the bevel of the actuator button and the angle of the resilient tongue relative to the drawer are exaggerated for clarity.

In the embodiment, the resilient tongue is arranged to assume an unloaded position when the drawer is in its operative, dispensing position. The angle of the resilient tongue relative to the side wall of the drawer and the thickness of the actuator button are selected so that at least the outermost surface of the actuator button is flush with, or just inside, the outer surface of the side wall of the dispenser.

Figure 4B:
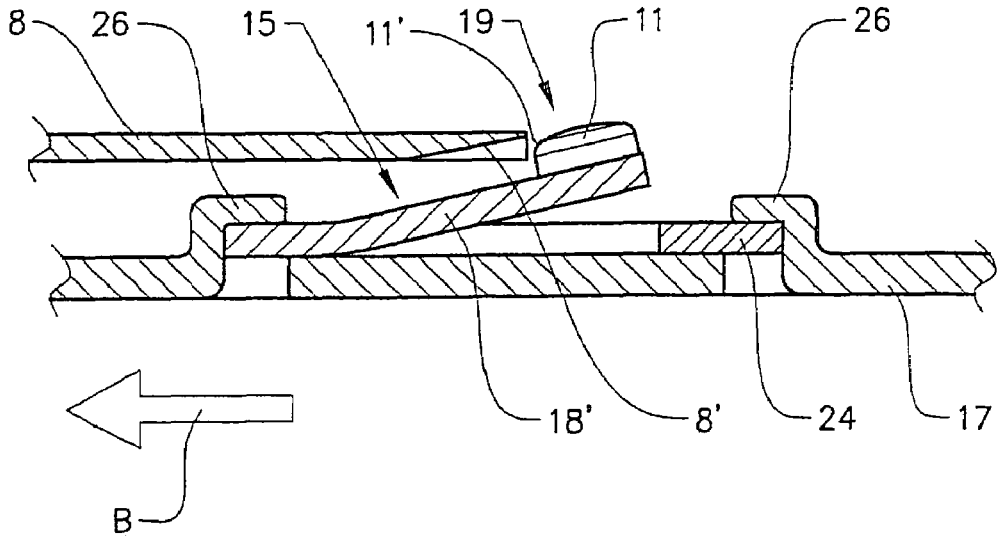
FIG. 4B shows a cross-section of the locking mechanism of FIG. 3, prior to closing the dispenser.

FIG. 4B shows a cross-section x-x of the locking mechanism of FIG. 3, as the locking mechanism is about to engage the front end of the open-ended body, during the closing of the dispenser. The arrow B indicates the direction of movement of the drawer when the dispenser is being closed. When approaching the front end of the dispenser, the bevelled rear end 11' of the actuator button 11 comes into contact with a bevelled guide surface 8' cut into the inner wall of the side wall 8. The outer, initial part of the bevelled guide surface 11', at the point where it exits into the end surface of the wall 8, must be located closer to the plane of the outer surface of the wall 8 of the dispenser than the rear end 11' of the outer surface of the actuator 11. The extension of the guide surface at right angles to the longitudinal axis of the resilient member is at least equal to the width, or in this case the diameter, of the actuator button 11. This arrangement prevents the actuator button from catching the outer end of the side wall and minimises the abrasive wear of the actuator button.

Figure 5:
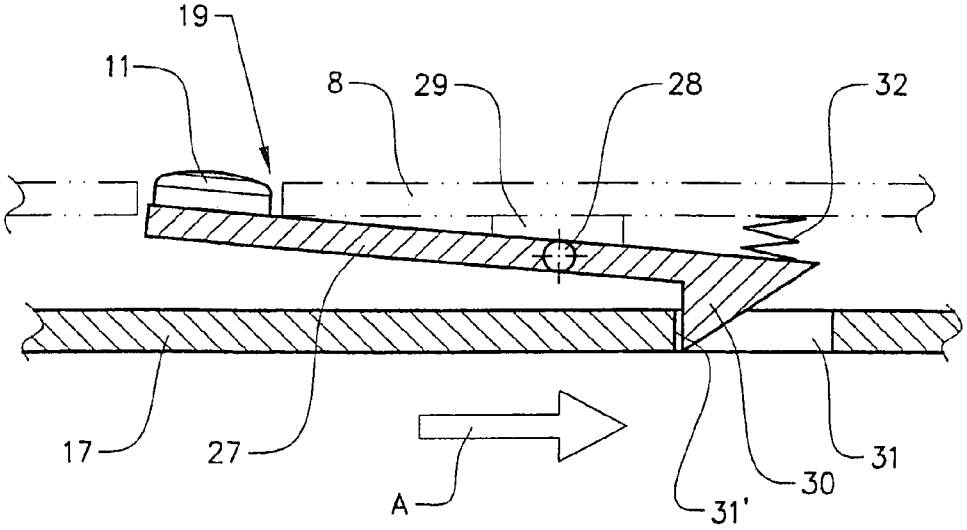
FIG. 5 shows a cross-section of an alternative locking mechanism according to a third embodiment of the invention.

FIG. 5 shows a cross-sectional view of a locking mechanism according to a third embodiment of the invention. In this case, the locking mechanism comprises a lever arm 27 that may be pivoted around a pivot axis 28. An attachment 29 for the lever arm 27 is attached to the inner wall of the side wall

8 of the dispenser. As in the first and the second embodiments, the locking mechanism comprises an actuator button 11, which in this case is attached to a first end of the lever arm 27 and can be actuated through the hole 19 in the side wall 8 of the dispenser. The opposite, second end of the lever arm 27 is provided with a projection 30 extending at substantially right angles to the side wall 17 of the drawer and into an opening 31 thereof. The projection 30 cooperates with an edge 31' of said opening 31 to hold the drawer in its operative position. In order to maintain the lever arm 27 and the projection in a locked position, a suitable biasing means such as a coiled spring 32 is provided between the side wall 8 of the dispenser and the second end of the lever arm 27. The arrow A indicates the direction of movement of the drawer when the locking mechanism 15 is released by depressing the actuator button 11 against the biasing force of the spring 32.

Figure 6A:
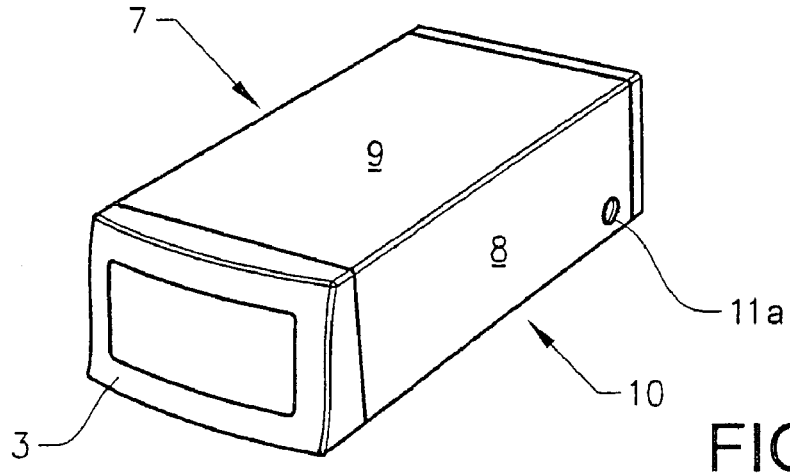
FIG. 6A shows a first alternative location of an actuator.
Figure 6B:
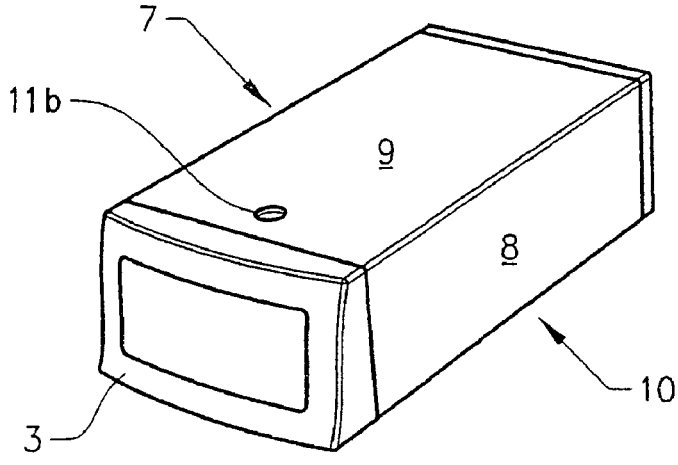
FIG. 6B shows a second alternative location of an actuator.
Figure 6C:
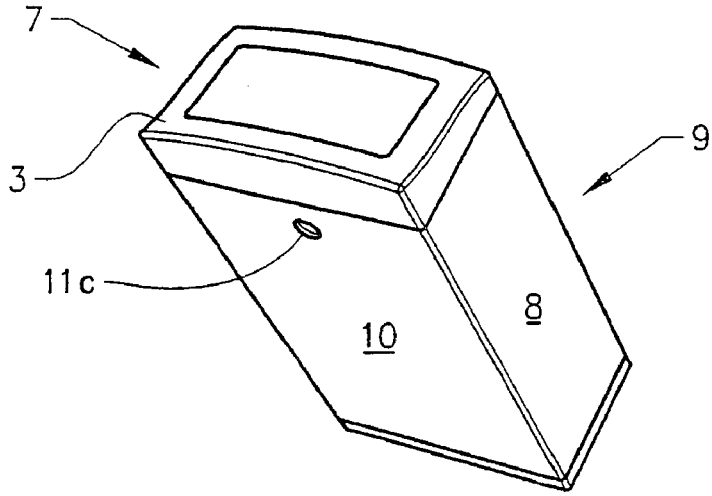
FIG. 6C shows a third alternative location of an actuator.

FIGS. 6A-6C shows a number of alternative locations for the actuator button. The dispensers shown in these figures use the same reference numerals as indicated in FIG. 1 with respect to the outer walls/panels of the dispenser.

FIG. 6A shows a first alternative location of an actuator button 11*a*, which button 11*a* is placed at the lower, rear end of the side wall 8 of the dispenser. The said button is preferably, but not necessarily, provided on both side walls 7, 8 of the dispenser.

FIG. 6B shows a second alternative location of an actuator button 11*b*, which button 11*b* is placed adjacent the front end of the upper wall 9 of the dispenser. As the front panel 3 is physically joined to the drawer (see FIG. 2), a locking mechanism provided at the upper side of the front panel may be defined as being a part of the drawer, or support member.

FIG. 6C shows a third alternative location of an actuator button 11*a*, which button 11*a* is placed adjacent the front end of the bottom wall 10 of the dispenser. In this case the locking mechanism is provided in or attached to underside of the drawer.

The invention is not limited to the embodiments described above and may be varied freely within the scope of the appended claims.

The invention claimed is

1. A dispenser for dispensing folded sheet products from a stack of said folded sheet products, said dispenser comprising:

an open-ended body;

a front panel, provided with a dispensing opening;

a rear panel;

a transverse panel located between said front and rear panels;

a support member for receiving said stack of said folded sheet products, said support member being movable with said front panel between open and closed positions of said dispenser;

and at least one locking mechanism located between the support member and at least one longitudinal wall of the open-ended body for releasably retaining said front panel and said support member in said closed position, wherein each locking mechanism is resiliently biased into a locking position, wherein each locking mechanism is provided with an actuator located on the support member, and wherein each actuator engages with a through hole in a corresponding longitudinal wall, in order to lock the support member in said closed position, each said actuator being actuated from outside said open-ended body.

2. The dispenser according to claim 1, wherein each actuator is located at one end of a resilient member arranged to bias the actuator into said through hole.

3. The dispenser according to claim 2, wherein the resilient member is a resilient tongue.

4. The dispenser according to claim 2, wherein the resilient member is attached to the support member.

5. The dispenser according to claim 4, wherein the resilient member comprises an integrated attachment section and resilient section.

6. The dispenser according to claim 3, wherein the resilient member is integrated with the support member.

7. The dispenser according to claim 1, wherein each actuator is located at one end of a pivoting lever.

8. The dispenser according to claim 7, further comprising a locking member located on an opposite end of the lever, and said locking member being resiliently biased into contact with the support member.

9. The dispenser according to claim 1, further comprising a biasing means located between said transverse panel and the open-ended body, which biasing means spring loads the support member, the front face and the transverse panel in the direction of the front end of the dispenser.

10. The dispenser according to claim 9, wherein the biasing means is arranged to displace the support member, the front face and the transverse panel a predetermined distance out of the dispenser upon release of the locking mechanism.

11. The dispenser according to claim 1, wherein each actuator is located in at least one side wall of the open-ended body.

12. The dispenser according to claim 1, wherein said actuator is located in a bottom wall of the open-ended body.

13. The dispenser according to claim 1, wherein the actuator is located in a top wall of the open-ended body.

14. The dispenser according to claim 1, wherein each actuator is arranged to cooperate with a bevelled guide surface adjacent the front end of said wall, upon closing of the dispenser.

* * * * *